US005571053A

United States Patent [19]

Lane

[11] Patent Number: 5,571,053

[45] Date of Patent: Nov. 5, 1996

[54] CANTILEVER-WEIGHTED GOLF PUTTER

[76] Inventor: Stephen P. Lane, P.O. Box 1683, Marshall, Tex. 75671

[21] Appl. No.: 514,797

[22] Filed: Aug. 14, 1995

[51] Int. Cl.[6] ..... A63B 53/04

[52] U.S. Cl. ..... 473/336; 473/340; 473/341

[58] Field of Search ..... 273/167 R, 167 F, 273/169, 170, 171, 172, 173, 174, 167 C, 167 H, 193 R, 194 R, 79, 162 R, 162 F; 473/336, 340, 341

[56] References Cited

U.S. PATENT DOCUMENTS

| | | | |
|---|---|---|---|
| D. 255,477 | 6/1980 | Gida . | |
| 1,453,503 | 5/1923 | Holmes | 273/171 |
| 1,518,316 | 12/1924 | Ellingham | 273/171 |
| 1,575,364 | 3/1926 | Hodgkins | 273/171 |
| 2,460,445 | 2/1949 | Bigler . | |
| 3,606,327 | 9/1971 | Gorman | 273/171 |
| 3,759,527 | 9/1973 | Witherspoon | 273/171 |
| 4,052,075 | 10/1977 | Daly | 273/171 |
| 4,195,842 | 4/1980 | Coleman | 273/171 |
| 4,508,342 | 4/1985 | Drake . | |
| 4,872,684 | 10/1989 | Dippel . | |
| 4,895,371 | 1/1990 | Bushner . | |
| 4,902,015 | 2/1990 | Nebbia . | |
| 4,962,932 | 10/1990 | Anderson | 273/171 |
| 5,172,915 | 12/1992 | Flis . | |
| 5,193,806 | 3/1993 | Burkly . | |
| 5,354,060 | 10/1994 | Wooten . | |

FOREIGN PATENT DOCUMENTS

| | | | |
|---|---|---|---|
| 194823 | 3/1923 | United Kingdom | 273/171 |
| 252995 | 6/1926 | United Kingdom | 273/171 |

*Primary Examiner*—Sebastiano Passaniti
*Attorney, Agent, or Firm*—John M. Harrison

[57] ABSTRACT

A cantilever-weighted golf putter which is characterized by an elongated putter head having a rounded bottom and sides and a flat top, with a longitudinal heel bore and toe bore provided in the heel and toe, respectively, of the putter head. A pair of threaded plugs fitted with a central opening and a recessed area communicating with the central opening are threaded into the heel bore and toe bore, respectively, for receiving bolts, such that the bolt heads are recessed in the recessed areas of the plugs and the threaded bolt shanks extend into the heel bore and toe bore, respectively. Each of the bolts is fitted with internally-threaded weights threadably secured in place on the bolts by means of nuts, such that the multiple weight system on each bolt is mounted in cantilever relationship in the heel bore and toe bore, respectively, of the putter head, without touching the heel and toe bore walls. A shaft mount bore is provided in the flat top of the elongated putter head in conventional fashion to receive a putter shaft. The heel bore and toe bore are drilled or molded in longitudinally aligned relationship and are internally spaced at a rounded "sweet spot" on the putter head for contacting a golf ball while putting.

20 Claims, 1 Drawing Sheet

CANTILEVER-WEIGHTED GOLF PUTTER

BACKGROUND OF THE INVENTION

1. Field of the Invention

This invention relates to golf putters and more particularly, to a cantilever-weighted golf putter which is designed to concentrate the weight of the putter head at the extremities of the heel and toe of the putter. Concentration of a selected amount of weight at these extreme points in the putter head facilitates optimum stability in use of the putter when a golf ball is struck at the rounded "sweet spot" in the center of the putter substantially in alignment with the putter shaft.

One of the most difficult aspects of the game of golf is the use of a putter, which is typically used on a golf green to strike and propel the ball toward the cup. Putters are available in a variety of shapes, sizes and weights, but are primarily designed with a striking face which is usually flat to facilitate squarely striking the ball and hopefully, propelling the ball along a predetermined path which coincides with the cup. A desirable aspect of putting and particularly, effecting long putts, is "forward" spin imparted to the ball when the putter strikes the ball. The putter design should facilitate production of forward spin on the ball, while at the same time preventing the ball from hopping or skipping, particularly under circumstances where the ball must be struck hard in order to traverse a lengthy path on the green or from the fringes of the green onto the green and to the cup. Furthermore, the putter should be well balanced with the weight preferably distributed at the ends of the putter head to facilitate optimum stability in striking the ball at the center or "sweet spot" of the putter. Accordingly, it is desirable to provide a putter having weighted heel and toe margins with the "sweet spot" located between these margins, which putter is designed to impart forward spin to the ball and prevent the ball from hopping or skipping, particularly in the course of undertaking long putts. A putter should also be designed to minimize the effect of the tendency of golfers to slightly pivot the putter horizontally if the ball is not struck more or less in line with the center of gravity of the club at the "sweet spot" and one which will compensate for deviations in vertically positioning or "rolling" the putter shaft with respect to the green as the ball is viewed by the golfer and the putter is aligned with the ball.

2. Description of the Prior Art

Typical of the prior art golf putters known in the art is the "Golf Putter" detailed in U.S. Pat. No. 4,872,684, dated Oct. 10, 1989, to Stephanie A. Dippel. The golf putter has a substantially cylindrical club head made from a tough, resilient, non-metallic, plastic material and has weight-receiving receptacles recessed in each of the heel and toe ends. Weight inserts are provided in the weight-receiving receptacles and the diameter of the cylindrical club head is smaller than the diameter of a ball to be played. A visual alignment mark extends circumferentially partially around the cylindrical body at a position equidistant between the heel and toe ends and thus, just toward the toe and from the position at which a conventional shaft is coupled to the club head. U.S. Pat. No. 4,902,015, dated Feb. 20, 1990, to David G. Nebbia, details a "Golf Putter" having a putter head with rounded front and rear faces and a flat top and bottom. The putter head is substantially truncated cylindrical, with a bracket extension affixed onto the flat top of the putter head and a club shaft receipt aperture disposed in a central portion of the top of the bracket for receiving a club shaft. U.S. Pat. No. 5,193,806, dated Mar. 16, 1993, to Alfred J. Burkly, details a "Low-Flight Spin Control Chipper-Putter Golf Clubhead". The golf clubhead is manufactured from tropical hardwoods or metal and has a geometry based on functions of the base diameter of an impacting cylinder. The clubhead includes tapered underfaces, a tapered heel face, grooving on portions of the impact surface to promote spin momentum, swing-weight ports, swingweighting material and an upright shaft and ferrule. U.S. Pat. No. 5,354,060, dated Oct. 11, 1994, to Richard W, Wooten, details a "Golf Putter" having a putter head that includes a forward portion and a tail portion extending opposite from the forward portion. The forward portion includes a laterally-extending, rounded, forward top surface, to which a shaft is attached and a laterally extending, rounded striking surface that extends forwardly and downwardly from the forward top surface. The forward portion further includes a laterally-extending, planar, forward bottom surface extending rearwardly from the striking surface. The tail portion is generally coextensive with the forward portion and includes a laterally-extending, rounded, tail top surface and a laterally-extending, rounded tail bottom surface, which terminates in a rearmost tail tip. The putter forward portion defines a forward cavity and the tail portion defines a tail cavity, each of which are filled with lead to add weight to the putter head.

It is an object of this invention to provide a cantilever-weighted golf putter having an elongated putter head fitted with oppositely-disposed heel and toe bores and cantilever-mounted weights of desired magnitude located in the heel and toe bores to facilitate weight adjustment and concentration on the ends of the putter and stabilize the putter during putting.

Another object of this invention is to provide an elongated golf putter which is characterized by longitudinal heel and toe bores fitted with threaded plugs that mount corresponding bolts having threaded weights thereon, to define a dual cantilever-mounted weight system that distributes the weight of the cantilever-mounted weights at the heel and toe ends of the golf putter, thereby stabilizing the golf putter in use.

Yet another object of this invention is to provide a cantilever-weighted golf putter which is characterized by an elongated putter head having a flat top surface, rounded bottom and side surfaces and an internal longitudinal heel bore and toe bore for receiving a pair of cantilever-mounted bolts and internally-threaded weights attached to the bolts, to distribute the weight of the weight system at the heel and toe ends of the elongated putter head, rather than along the length of the heel bore and toe bore and therefore facilitate greater stability in striking a golf ball at the "sweet spot" located on the putter head between the heel and toe cantilever weight systems.

Still another object of this invention is to provide an elongated putter head for a golf putter, which putter head is characterized by a flat top having a shaft mount bore for receiving and mounting a conventional shaft and rounded bottom and sides, with a rounded "sweet spot" at the center of the putter head. Longitudinal heel and toe bores are provided in the heel and toe ends of the putter head, which heel and toe bores are longitudinally aligned, terminate short of the "sweet spot" and are each designed to receive a cantilever-mounted bolt and weight system, create a moment at the ends of the heel and toe of the putter head and stabilize the putter during use.

SUMMARY OF THE INVENTION

These and other objects of the invention are provided in a new and improved, dual cantilever-weighted golf putter which, in a preferred embodiment, includes an elongated putter head having rounded bottom and side surfaces and a flat top fitted with a conventional shaft and having longitudinal heel and toe bores extending from the heel and toe ends of the putter head into the putter head in facing, longitudinally-aligned relationship, and terminating inside the putter head. A pair of threaded plugs are inserted in the heel and toe ends of the partially internally-threaded heel and toe bores and accommodate a pair of round-head, flat-head, cap screw or hex-head bolts, the heads of which may be recessed in the plugs, respectively, which bolts carry multiple, internally-threaded weights of selected number and magnitude and serve to position the weights in cantilever fashion inside the heel and toe bores without touching the bore walls. This cantilever mounting of the weights creates a moment at the plugs and facilitates shifting of the center of gravity of each weight system to the respective ends of the putter head at the plugs to optimize stability in the putting process.

BRIEF DESCRIPTION OF THE DRAWING

The invention will be better understood by reference to the accompanying drawing, wherein.

DESCRIPTION OF THE PREFERRED EMBODIMENTS

Figures 1, 2, 3, 4, 5, 6, 7, 8, 9:
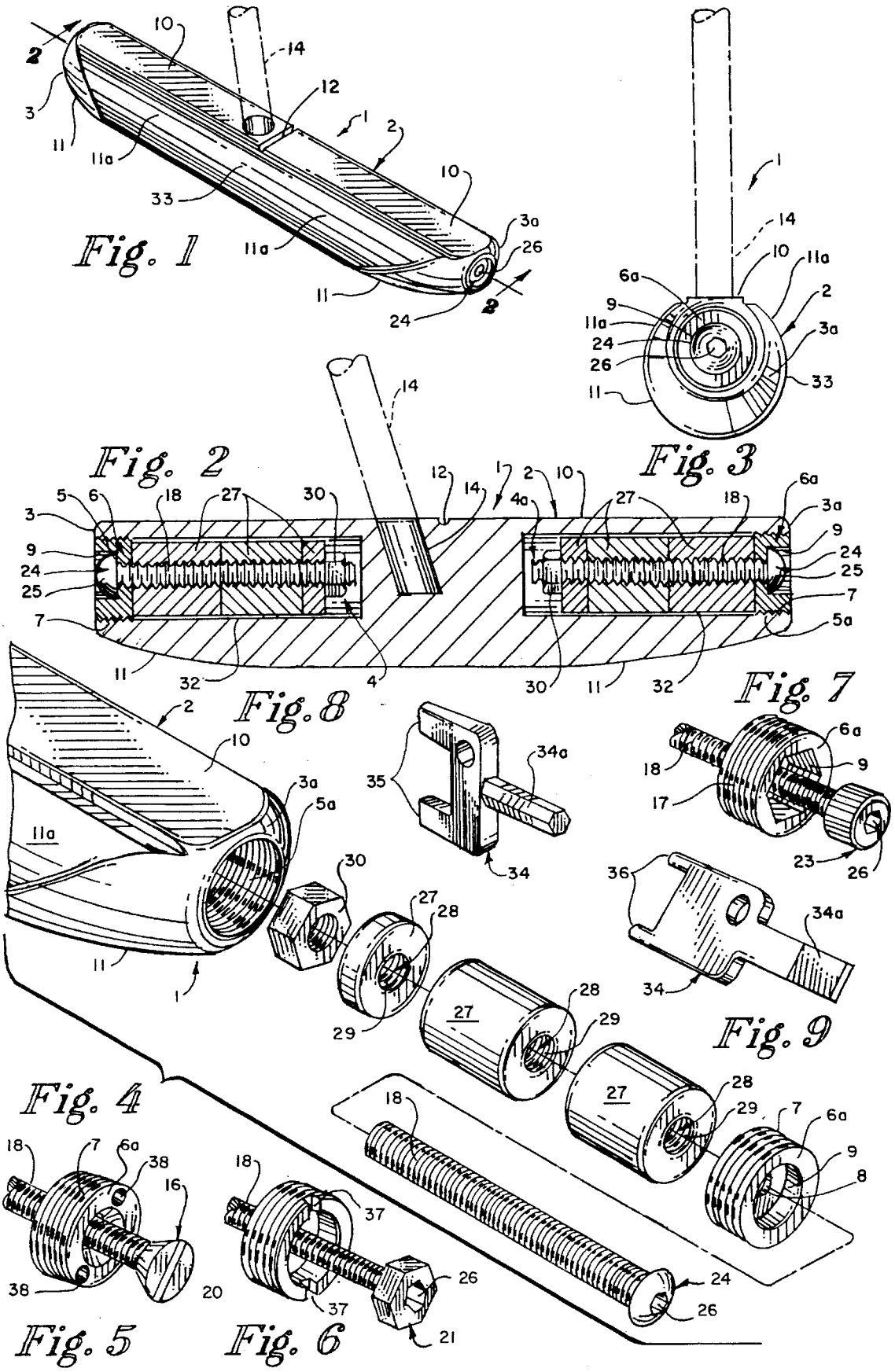
FIG. 1 is a perspective view of a preferred embodiment of the cantilever-weighted golf putter of this invention.
FIG. 2 is a sectional view taken along line 2—2 of the cantilever golf putter illustrated in FIG. 1.
FIG. 3 is a toe-end view of the cantilever-weighted golf putter illustrated in FIGS. 1 and 2.
FIG. 4 is an exploded view, partially in section, of the toe end of the cantilever golf putter illustrated in FIGS. 1–3.
FIG. 5 is a perspective view of a threaded plug and flathead bolt element of the putter cantilever weight system.
FIG. 6 is a perspective view of a threaded plug and hexhead bolt element of the putter cantilever weight system.
FIG. 7 is a perspective view of a threaded plug and capscrew element of the putter cantilever weight system.
FIG. 8 is a perspective view of a first plug drive tool.
FIG. 9 is a perspective view of a second plug drive tool.

Referring initially to FIGS. 1–4 of the drawing, in a preferred embodiment the golf putter of this invention is generally illustrated by reference numeral 1. The golf putter 1 is characterized by an elongated putter head 2 having a flat top margin 10, a rounded bottom 11, that merges into rounded sides 11*a*, a heel 3 and a toe 3*a*. A longitudinal heel bore 4 is drilled, cast or otherwise shaped or formed in the heel 3 of the putter head 2, while a corresponding longitudinal toe bore 4*a* is provided in the toe 3*a* of the putter head 2. In a most preferred embodiment of the invention the heel bore 4 and toe bore 4*a* terminate internally at the "sweet spot" 33 in the rounded longitudinal center of the putter head 2, and a transverse alignment slot 12 is provided in the flat top margin 10 to mark the "sweet spot" 33, as illustrated in FIG. 2. The heel bore 4 is fitted with internal heel bore threads 5 and the toe bore 4*a* is provided with corresponding internal toe bore threads 5*a*, as further illustrated in FIG. 2. A heel bore plug 6 is fitted with plug threads 7, which threadably engage the heel bore threads 5 and is thus threadably fit in the mouth of the heel bore plug 6 in the heel bore 4. Similarly, a toe bore plug 6*a*, also provided with plug threads 7, is threaded into the mouth of the toe bore 4*a*, with the plug threads 7 engaging the toe bore threads 5*a*, as further illustrated in FIG. 2. Each of the heel bore plug 6 and toe bore plug 6*a* are provided with a plug bolt opening 8 and a bolt head recess 9, for receiving a round-head bolt 24, as further illustrated in FIG. 2. The round-head bolt 24 is characterized by a threaded bolt shank 18 terminated on one end by a round head 25. The round head 25 of each round-head bolt 24 may be countersunk or recessed in the corresponding bolt head recess 9 of the heel bore plug 6 and toe bore plug 6*a*, respectively, when the bolt shank 18 of the round-head bolt 24 is inserted through the plug bolt opening 8 of the heel bore plug 6 and toe bore plug 6*a*, respectively. Alternatively, the round head 25 may engage the flat surface (not illustrated) of a toe bore plug 6*a* not fitted with a bolt head recess 9, as desired. Referring to FIGS. 5, 6, 8 and 9 of the drawing, the heel bore plug 6 and toe bore plug 6*a* may be fitted with plug holes 38 or plug slots 37, illustrated in FIGS. 5 and 6, respectively, which receive the corresponding drive plugs 36 and drive tabs 35 of the plug drive tools 34, respectively, illustrated in FIGS. 8 and 9. A socket or wrench (not illustrated) may be applied to the respective tool shanks 34*a* of the plug drive tools 34 to tighten and loosen the heel bore plug 6 and toe bore plug 6*a*, as required. Since the heel bore plug 6 and toe bore plug 6*a* are threaded in the heel bore 4 and toe bore 4a, respectively, of the putter head 2, both the heel bore plug 6 and toe bore plug 6a can be removed from the heel bore 4 and toe bore 4*a* as described above to facilitate threadably mounting one or more cylindrical weights 27 of selected size and weight on the bolt shanks 18 of the respective round-head bolts 24. Each of the cylindrical weights 27 is characterized by a longitudinal weight bore 28, fitted with internal bore threads 29 and the weights 27 are preferably threadably retained on each of the threaded bolt shanks 18 of the round head bolts 24 by means of a nut 30. Accordingly, it will be appreciated that when one or more of the weights 27 are threadably applied to and mounted on the respective bolt shanks 18 of the round-head bolts 24 and the round-head bolts 24 are, in turn, mounted on each of the heel bore plug 6 and toe bore plug 6*a*, and when the heel bore plug 6 and toe bore plug 6 are threadably inserted in the respective heel bores 4 and toe bore 4*a* of the putter head 2, then the bolt shanks 18 and weights 27 are extended into the heel bore 4 and toe bore 4*a* in cantilever fashion. This cantilever mounting of the weights 27 is facilitated since the diameter of the weights 27 is less than the internal diameter of the heel bore 4 and toe bore 4*a*, to create an annular weight clearance 32 between the outside diameter of the weights 27 and the diameter of the heel bore 4 and toe bore 4*a*, as illustrated in FIG. 2.

It will be appreciated by those skilled in the art that various types of conventional bolts can be used to mount the weights 27 in the heel bore 4 and toe bore 4*a* of the putter head 2. These include a flat-head bolt 16, having a flat head 17, which may be recessed in the corresponding bolt head recess 9 of the respective heel bore plug 6 and toe bore plug 6*a*, as well as a cap screw 23, having a hex drive slot 26 and a hex-head bolt 21, having a hex-head 22, also for recessing in the bolt head recess 9 of the heel bore plug 6 and toe bore plug 6*a*, respectively. Each of the round head 25 of the round-head bolt 24 and the flat head 17 of the flat-head bolt 16 may be provided with a conventional drive slot 20, a hex drive slot 26 or a "phillips" or alternative drive-receptacle or slot (not illustrated) as desired, in order to seat and remove the respective heel bore plug 6 and toe bore plug 6*a* in the respective heel bore 4 and toe bore 4*a*. Alternatively, the entire heel bore plug 6 and toe bore plug 6*a* assemblies can be removed by equipping the heel bore plug 6 and the toe bore plug 6*a* with either the plug slots 37 or the plug holes 38 and using the appropriate plug drive tool 34 to drive the heel bore plug 6 and toe bore plug 6*a*, as heretofore described.

In a most preferred embodiment of the invention a shaft mount bore 13 is provided in the flat top margin 10 of the putter head 2 for receiving a shaft 14 in conventional fashion and the shaft mount bore 13 is provided at the "sweet spot" 33, to facilitate proper balancing of the golf putter 1.

It will be appreciated by those skilled in the art that the cantilever-weighted golf putter of this invention is versatile and can be manufactured in substantially any size, length of putter head 2 and weight, depending upon the number, weight and size of the cylindrical weights 27 which are mounted on the respective bolt shanks 18 of the flat-head bolt 16, round-head bolt 24, cap screw 23 or hex-head bolt 21, respectively. Furthermore, since the effective weight of each set of the weights 27 is applied to the extreme ends of the heel 3 and toe 3*a* of the putter head 2 by a moment which operates at each of the heel bore plug 6 and toe bore plug 6*a*, the spreading of these centers of gravity outwardly facilitates greater stability in aligning and striking the golf ball at the "sweet spot" 33. This is so, because there is less tendency for the putter head 2 to tilt or shift longitudinally as the cantilever-weighted golf putter 1 strikes the ball, due to the extreme weight distribution in the putter head 2. Furthermore, it will be appreciated that various numbers and sizes of the weights 27 may be added to or taken from the bolt shanks 18 of the respective flat-head bolts 16, hex-head bolt 21, cap screw 23 or round-head bolts 24 by first removing both of the bolt-weight system from the heel bore 4 and toe bore 5*a* and removing the respective nuts 30 from the corresponding bolt shanks 18. This facilitates a desired cantilever weight distribution in the putter head 2 to suit individual putting styles, positions, and shaft inclinations.

While the preferred embodiments of this invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A cantilever-weighted golf putter comprising a putter head having opposite ends and a center, a "sweet spot" or golf ball contact area located at substantially the center of said putter head, a shaft extending from said putter head adjacent to said contact area to facilitate balancing of said golf putter, at least one longitudinal bore provided in said putter head and weight means cantilever-mounted in said opposite ends of said putter head, said weight means projecting into said longitudinal bore in cantilever relationship from said opposite ends, respectively, of said putter head, defining a clearance between said weight means and said at least one longitudinal bore.

2. The cantilever-weighted golf putter of claim 1 wherein said weight means comprises a bolt mounted in each of said opposite ends of said putter head and projecting into said longitudinal bore and at least one weight provided on said bolt.

3. The cantilever-weighted golf putter of claim 2 comprising a plug threaded in each of said opposite ends of said putter head and wherein said bolt is mounted in said plug.

4. The cantilever-weighted golf putter of claim 1 wherein said at least one longitudinal bore comprises a separate longitudinal bore extending from said opposite ends of said putter head toward said center of said putter head.

5. The cantilever-weighted golf putter of claim 1 wherein:

(a) said weight means comprises a bolt mounted in said opposite ends of said putter head and projecting into said longitudinal bore and at least one weight provided on said bolt; and (b) said at least one longitudinal bore comprises a separate longitudinal bore extending from said opposite ends of said putter head toward said center of said putter head.

6. The cantilever-weighted golf putter of claim 5 comprising a plug threaded in each of said opposite ends of said putter head and wherein said bolt is mounted in said plug.

7. The cantilever-weighted golf putter of claim 3 comprising recess means provided in said plug and comprising a plug drive tool for engaging said recess means and selectively threadably inserting and removing said plug, said bolt and said weight from said longitudinal bore at said opposite ends of said putter head.

8. The cantilever-weighted golf putter of claim 7 wherein said at least one longitudinal bore comprises a separate longitudinal bore extending from said opposite ends of said putter head toward said center of said putter head.

9. The cantilever-weighted golf putter of claim 2 wherein said at least one weight comprises a plurality of cylindrical weights removably provided on said bolt.

10. The cantilever-weighted golf putter of claim 9 comprising a plug threaded in each of said opposite ends of said putter head and wherein said bolt is mounted in said plug.

11. The cantilever-weighted golf putter of claim 10 wherein said at least one longitudinal bore comprises a separate longitudinal bore extending from said opposite ends of said putter head toward said center of said putter head.

12. The cantilever-weighted golf putter of claim 11 comprising recess means provided in said plug and comprising a plug drive tool for engaging said recess means and selectively threadably inserting and removing said plug, said bolt and said cylindrical weights from said longitudinal bore at said opposite ends of said putter head.

13. A cantilever-weighted golf putter comprising an elongated, rounded putter head having a toe end, a heel end and a center portion; a "sweet spot" or golf ball contact area located at substantially the center of said putter head; a shaft extending from said putter head adjacent to said contact area to facilitate balancing of said golf putter; a first longitudinal bore provided in the toe end of said putter head and a second longitudinal bore provided in the heel end of said putter head opposite from said toe end; first cantilever weight means mounted on said toe end of said putter head and extending into said first longitudinal bore without touching said first longitudinal bore beyond said toe end and second cantilever weight means mounted on said heel end of said putter head and extending into said second longitudinal bore without touching said second longitudinal bore beyond said heel end, defining a clearance between said first cantilever weight means and said first longitudinal bore and between said second cantilever weight means and said second longitudinal bore, whereby said putter head is weighted at said toe end by said first cantilever weight means and at said heel end by said second cantilever weight means.

14. The cantilever-weighted golf putter of claim 13 wherein said first cantilever weight means and said second cantilever weight means each comprises a pair of bolts mounted in said toe end and said opposite heel end, respectively, of said putter head and at least one cylindrical weight provided on each of said bolts.

15. The cantilever-weighted golf putter of claim 14 comprising a pair of plugs threaded in said toe end and said heel end of said putter head, respectively, and wherein said bolts are mounted in said plugs, respectively.

16. The cantilever-weighted golf putter of claim 13 comprising a first plug threaded in said toe end of said putter head, a second plug threaded in said heel end of said putter head and wherein said first cantilever weight means comprises a first bolt mounted in said first plug and at least one first cylindrical weight mounted on said first bolt and said second cantilever weight means comprises a second bolt mounted in said second plug and at least one second cylindrical weight mounted on said second bolt.

17. The cantilever-weighted golf putter of claim 16 comprising recess means provided in said first plug and said second plug and comprising a plug drive tool for engaging said recess means and selectively threadably inserting and removing said first plug and said second plug, said first bolt and said second bolt and said first cylindrical weight and said second cylindrical weight from said longitudinal bore at said toe end and said heel end of said putter head, respectively.

18. A cantilever-weighted golf putter comprising an elongated putter head having a rounded bottom, rounded sides and a flat top; a longitudinal bore provided in each end of said putter head, each of said bore terminating short of the center of said putter head; a "sweet spot" or golf ball contact area located at substantially the center of said putter head; a shaft extending from said flat top of said putter head adjacent to said contact area to facilitate balancing of said golf putter; a plug threaded in each end of said putter head to close said bore, respectively; a bolt extending through each of said plug into each of said bores; and weight means provided on each of said bolts, said weight means extending into each of said bore and spaced from the wall of said bore, respectively, whereby a moment of said weight means is generated at said plug, respectively.

19. The cantilever-weighted golf putter of claim 18 wherein said weight means comprises at least one cylindrical weight provided on said bolt, respectively, wherein the diameter of said weight is less than the diameter of the wall of said bore, respectively.

20. The cantilever-weighted golf putter of claim 19 wherein said at least one cylindrical weight comprises a plurality of cylindrical weights of selected size and magnitude for adjusting the magnitude of the moment.

* * * * *